US007850391B2

(12) United States Patent
Omar

(10) Patent No.: US 7,850,391 B2
(45) Date of Patent: Dec. 14, 2010

(54) FIXED BOLLARD SYSTEM

(76) Inventor: Tarek Ahmed Omar, 14354 Forestdale Ct., Woodbridge, VA (US) 22193

( * ) Notice: Subject to any disclaimer, the term of this patent is extended or adjusted under 35 U.S.C. 154(b) by 144 days.

(21) Appl. No.: 11/938,170

(22) Filed: Nov. 9, 2007

(65) Prior Publication Data

US 2008/0112756 A1 May 15, 2008

Related U.S. Application Data

(60) Provisional application No. 60/857,800, filed on Nov. 9, 2006.

(51) Int. Cl.
*E01F 9/011* (2006.01)

(52) U.S. Cl. ..... 404/6; 256/13.1

(58) Field of Classification Search ..... 404/6, 404/9; 256/13.1

See application file for complete search history.

(56) References Cited

U.S. PATENT DOCUMENTS

| | | | | |
|---|---|---|---|---|
| 6,702,512 | B1 * | 3/2004 | Reale | 404/6 |
| 2006/0090408 | A1 * | 5/2006 | Darcy | 52/174 |
| 2006/0140716 | A1 * | 6/2006 | Skalka | 404/6 |
| 2007/0086858 | A1 * | 4/2007 | Morgan et al. | 404/6 |
| 2008/0038056 | A1 * | 2/2008 | Patel | 404/6 |
| 2009/0028638 | A1 * | 1/2009 | Crawford et al. | 404/6 |

FOREIGN PATENT DOCUMENTS

| | | | |
|---|---|---|---|
| WO | WO 2007091977 | * | 2/2006 |
| WO | WO 2007091978 | * | 2/2007 |

OTHER PUBLICATIONS

RSA Protective Technologies, LLC, *Installation of RSA/K&C Shallow Mount Bollards Brochure*, Upland, California, publically disclosed at least as early as Nov. 1, 2006.

* cited by examiner

*Primary Examiner*—Raymond W Addie
(74) *Attorney, Agent, or Firm*—Workman Nydegger

(57) ABSTRACT

A fixed bollard system includes a plurality of spaced apart, elongated bollards each longitudinally disposed along a corresponding X-axis, each bollard being comprised of an I-beam having a front face and a opposing back face extending between a top end and an opposing bottom end. A plurality of horizontal support beams are each longitudinally disposed along a corresponding Y-axis, each horizontal support beam being comprised of an I-beam and having a first end and an opposing second end, the first end of each horizontal support beam being connected to the back face of a corresponding bollard at the bottom end thereof. An elongated lateral front beam connects to the front face of each of the plurality of bollard at the bottom ends thereof. An elongated lateral rear beam connects to the second end of each of the plurality of horizontal support beams.

21 Claims, 9 Drawing Sheets

FIXED BOLLARD SYSTEM

CROSS-REFERENCE TO RELATED APPLICATIONS

This application claims priority to U.S. Provisional Application Ser. No. 60/857,800, filed Nov. 9, 2006, which for purposes of disclosure is incorporated herein by specific reference.

BACKGROUND OF THE INVENTION

1. The Field of the Invention

The present invention relates to fixed bollard systems and, more particularly, to fixed bollard systems capable of sustaining a K-12 impact test.

2. The Relevant Technology

Bollards comprise short posts, often used in a series, that are designed for diverting or excluding motor vehicles from a defined area. For example, bollards are increasingly being positioned around federal government buildings, historical sites, and military bases to prevent vehicles from driving into or adjacent to such structures. One conventional type of bollard simply comprises a large metal post that is positioned within a deep hole. The hole is then back filed with rebar and concrete so that only the top of the post projects above the ground surface. The strength of the post, the depth of the post, and the amount of concrete supporting the post are factors determining the size of impact the post or bollard can sustain without failure.

Although such conventional bollards are useful, they have significant drawbacks. For example, it is often desirable to place bollards around a preexisting building or structure. It is often difficult, however, to dig deep holes about a city structure without hitting utility lines such as water lines, gas lines, telephone cables or the like. As a result, such bollards either have a shallow anchor, and thus low impact resistance, or substantial effort must be made to move the utility lines.

In one approach to solving the above problems, bollards have been designed having specially fabricated anchors that connect to the bollards. Although such anchors can have a lower profile, they still typically have a thickness of greater than two feet. Furthermore, the anchors must be specially fabricated, thereby increasing their cost and limiting their applicability.

Another problem with conventional bollards is that they can be very labor intensive to install on-sight.

Accordingly, what is needed are fixed bollard systems that have a low profile design, that can withstand high impacts, that can be manufactured with conventional off-the-shelf parts and/or that have decreased labor requirements for on-sight installation.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

The present invention relates to fixed bollard systems and, more particularly, fixed bollard systems that are capable of passing a K-12 impact test as defined by the Department of State ("DOS"). In general, to pass a K-12 impact test, the bollard system must be able to stop a 15,000 pound truck moving at a velocity of 50 mph. Further details with regard to the K-12 impact test can be found at "Test Method for Vehicle Crash Testing of Perimeter Barriers and Gates", *Physical Security Division, DOS, SD-STD*-02.01, Revision A, March 2003. In alternative embodiments, the fixed bollard systems of the present invention need not be capable of passing a K-12 impact test but can be configured to pass a lower impact test such as a K-8 or K-4 impact test as defined by the DOS.

Figure 1:
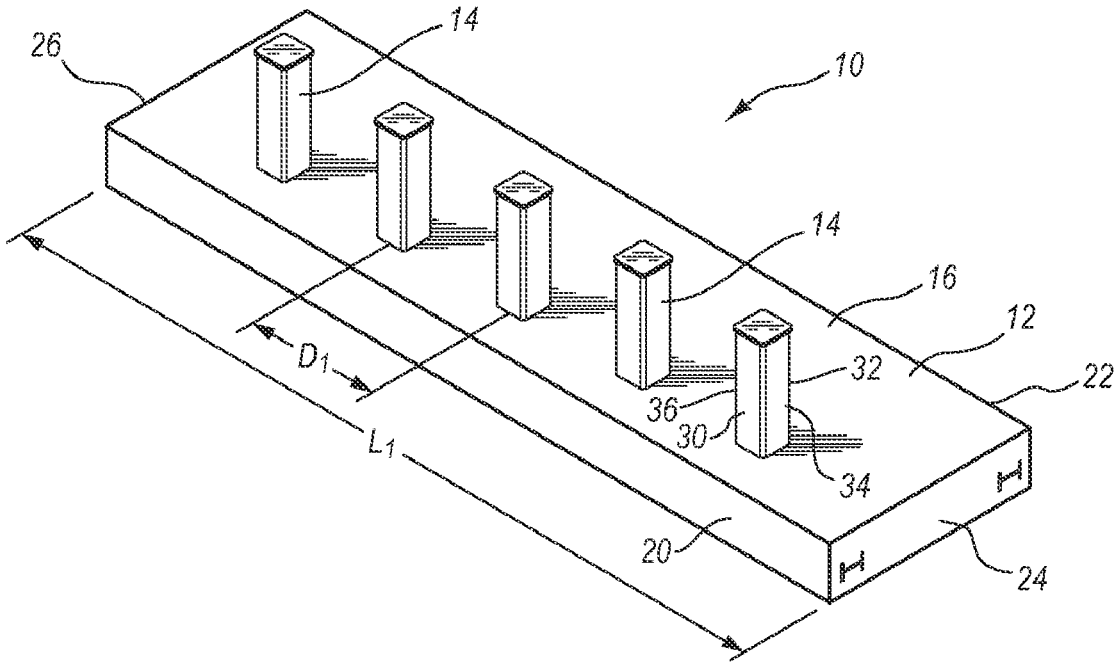
FIG. 1 is perspective view of an inventive fixed bollard system incorporating features of the present invention.
Figure 2:
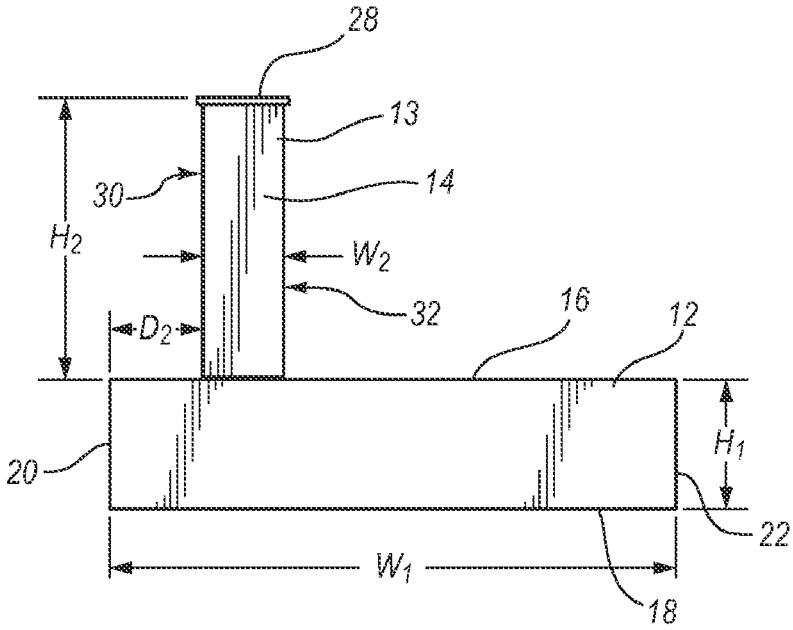
FIG. 2 is an elevated side view of the fixed bollard system shown in FIG. 1.

Depicted in FIG. 1 is one embodiment of an inventive fixed bollard system 10 incorporating features of the present invention. Fixed bollard system 10 includes a base 12 and a plurality of spaced apart bollards 14 upwardly projecting therefrom. As depicted in FIGS. 1 and 2, base 12 is depicted having a substantially rectangular, parallel piped configuration. Specifically, base 12 has a top surface 16 and an opposing bottom surface 18 that are disposed in substantially parallel planes. Top and bottom surface 16 and 18 extend between a front face 20 and an opposing back face 22 and also between opposing end faces 24 and 26. In the embodiment depicted, front face 20 and back face 22 are disposed in parallel planes while end faces 24 and 26 are also disposed in parallel planes. In alternative embodiments, however, it is appreciated that the opposing surfaces and faces need not be disposed in opposing parallel planes but can be disposed in intersecting planes or the opposing surfaces and faces can be irregular or contoured.

Base 12 has a height $H_1$ extending between surfaces 16 and 18 that is typically in a range between about 15 inches to about 21 inches, with about 17 inches to about 19 inches being common and about 18 inches being most common. Other heights can also be used. Base 12 has a width $W_1$ extending between faces 20 and 22 that is typically in a range between about 6 feet to about 7 feet, with about 6.25 feet to about 6.75 feet being common, and about 6.5 feet being most common. Other widths can also be used. In the illustrated example, base 12 has a length $L_1$ extending between faces 24 and 26 in a range between about 20 feet to about 30 feet, with about 22 feet to about 26 feet being more common and about 24 feet being most common. It is appreciated that the length $L_1$ can be any desired length and is based solely upon the amount of territory to be protected by fixed bollard system 10.

Bollards 14 upwardly project from top surface 16 of base 12 so as to project orthogonal to base 12. As will be discussed below in greater detail, a portion of each bollard 14 is disposed within base 12. The exposed portion 13 of each bollard 14 has a height $H_2$ extending from top surface 16 of base 12 to a freely exposed terminal end face 28 that is typically in a range between about 32 inches to about 42 inches with about 36 inches to about 40 inches being more common and about 39 inches being most common. Other heights can also be used. Each bollard 14 is also shown having a substantially square transverse cross section with all sides having a width $W_2$ in a range between about 10 inches to about 12 inches with about 11 inches being more common. Other widths and configurations can also be used.

Bollards 14 are spaced apart on center by distance $D_1$ that is typically in a range between about 3.5 feet to about 4.5 feet with about 3.75 feet to about 4.25 feet being more common and about 4 feet being most common. Other distances can also be used. Although fixed bollard system 10 is shown having five bollards 14, in other embodiments other numbers of bollards 14 can be used. For example, fixed bollard system 10 can comprise at least three bollards 14 or six or more bollards 14.

Each bollard 14 has a front face 30 an opposing back face 32 with opposing side faces 34 and 36 that extend therebetween. Bollards 14 are positioned back from front face 20 of base 12 by distance $D_2$ extending between front face 20 of base 12 and front face 30 of bollard 14 in a range between about 10 inches to about 16 inches with about 12 inches to about 14 inches being more common and about 13 inches being most common. Other distances can be used.

Discussion will now be made as to the structural components and methods of manufacturing bollards 14 and base 12. The following discussion provides dimensions for one specific example for forming fixed bollard system 10 to sustain a K-12 impact test, as discussed above. It is again noted, however, that fixed bollard system 10 is not limited to bollard systems that can sustain a K-12 impact test and that in alternative embodiments, the dimensions for the different components can be varied.

Figure 3:
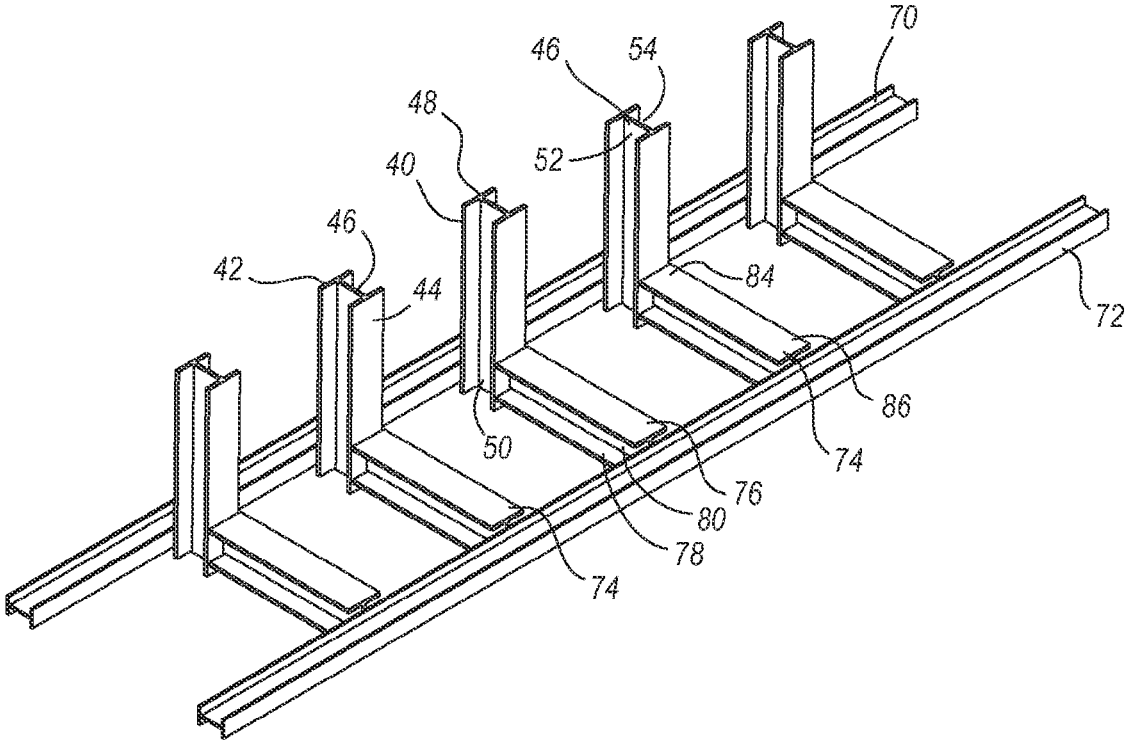
FIG. 3 is a perspective view of select components of the fixed bollard system shown in FIG. 1 including a front beam, rear beam, horizontal support beam, and vertical support beam.

As depicted in FIG. 3, each bollard 14 comprises a vertical support beam 40. Each vertical support beam 40 typically comprises an I-beam and, more commonly, a wide flange beam (W-beam) having a nominal size of about 10 inches by 10 inches, a weight of about 100 pounds per foot and a length of about 56 inches. Other lengths and sizes can also be used. Of the length of 56 inches, 18 inches are typically embedded within base 12 while the remaining 38 inches extend above top surface 16 of base 12. Vertical support beam 40 has a substantially I-shaped configuration that includes a front flange 42, a back flange 44, and a web 46 centrally extending therebetween. Each vertical support beam 40 extends between a top end 48 and an opposing bottom end 50. Opposing channels 52 and 54 extend along the length of vertical support beam 40 on opposing sides of web 46.

Figure 4:
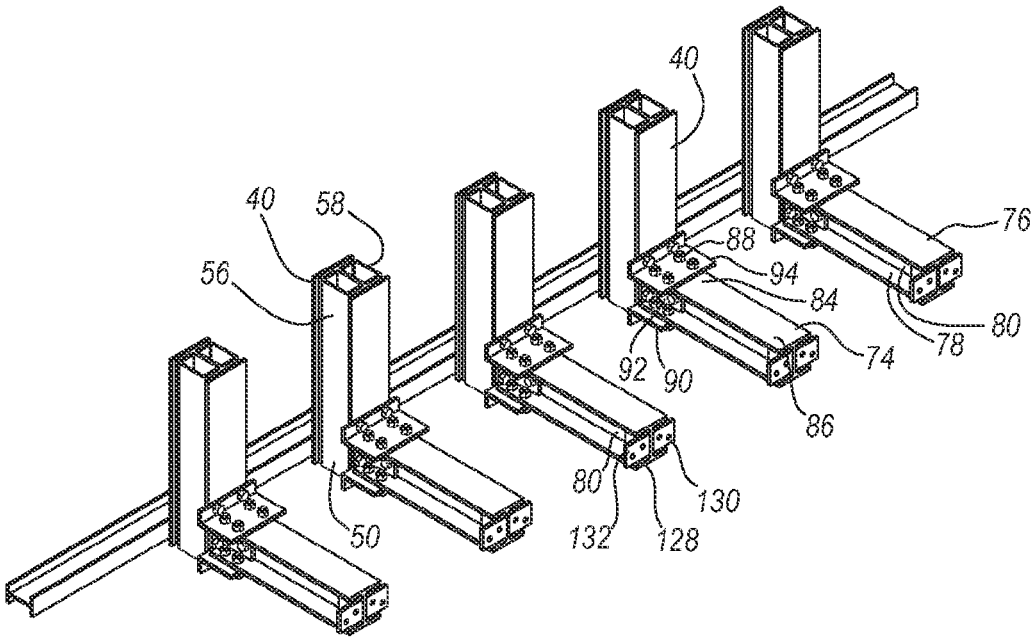
FIG. 4 is a perspective view of the components of the fixed bollard system shown in FIG. 3 further including rectangular tubes coupled with the vertical support beam and a plurality of brackets connecting the horizontal support beam to the vertical support beam together with the front beam.
Figure 7:
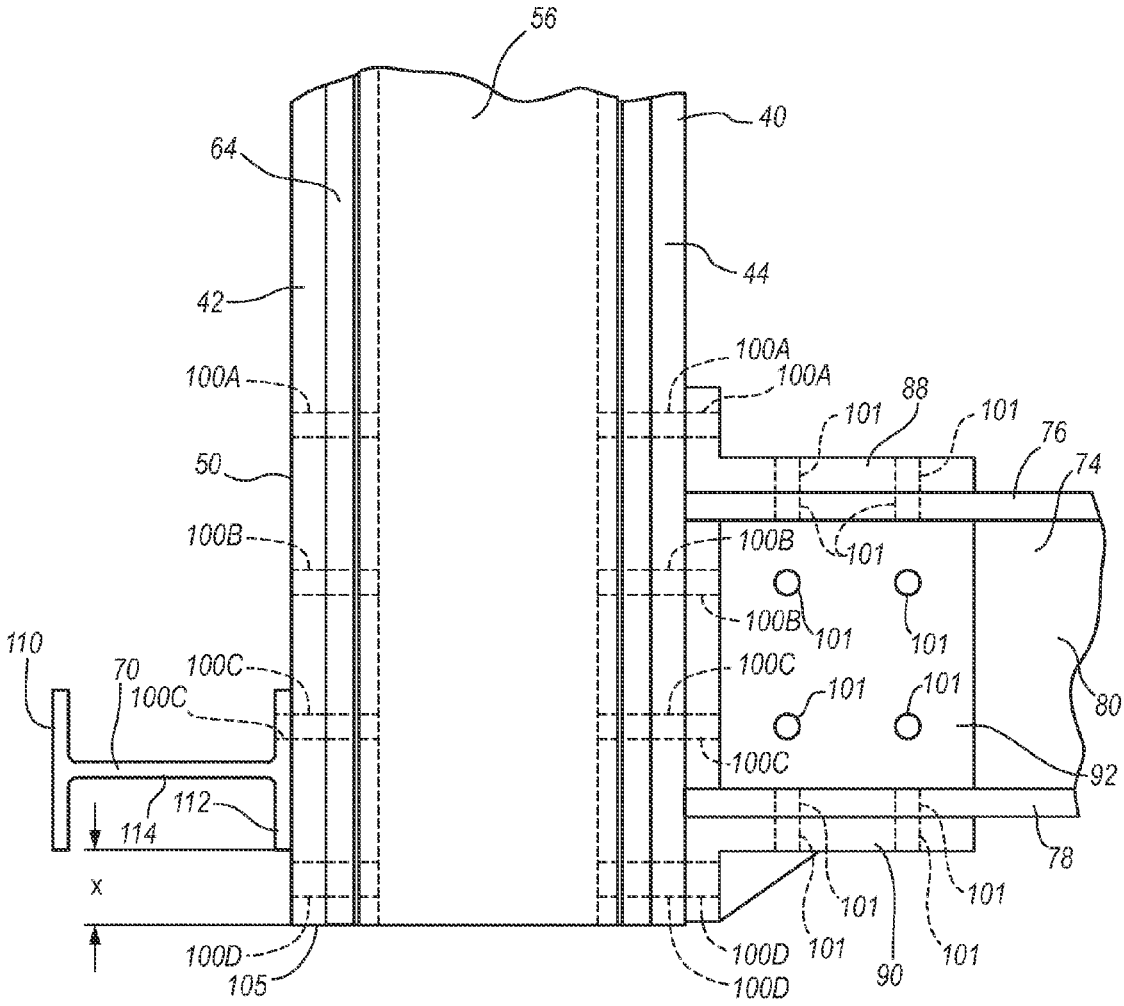
FIG. 7 is an elevated side view of the main joints of the bollard system shown in FIG. 5 wherein hidden openings are shown by dash lines.

As depicted in FIG. 4, each bollard 14 further comprises a tube 56 disposed with channel 52 (FIG. 3) and a tube 58 disposed with channel 54 (FIG. 3) of vertical support beam 40. In the present embodiment, each tube 56 and 58 has a substantially rectangular transverse cross section that is about 4 inches by 8 inches with a thickness of about 0.5 inches and a length of about 56 inches. As a result, each tube 56 and 58 is received within a corresponding channel 52, 54 and extends along the full length thereof In the present embodiment, however, tubes 56 and 58 do not completely fill channels 52, 54. As such, as depicted in FIG. 7, an elongated filler plate 64 can be positioned within channel 52 (FIG. 3) between tube 56 and front flange 42 of vertical support beam 40. An identical filler plate 64 can also be positioned within channel 54 (FIG. 3) between tube 58 and front flange 42 of vertical support beam 40. Each filler plate 64 typically has a width of about 4 inches, a thickness of about 0.375 inches, and a length of about 56 inches.

As also depicted in FIG. 7, and as will be discussed below in greater detail, four pairs of bolt holes 100A, 100B, 100C and 100D are vertically spaced apart along bottom end 50 of vertical support beam 40 with bolt holes 100A being the highest bolt holes and bolt holes 100D being the lowest bolt holes. All of bolt holes 100A-C have a diameter of about 1 inch while bolt holes 100D have a diameter of about 1.5 inches. Each of the bolt holes of the pair of bolt holes 100A, 100B, 100C and 100D are laterally spaced apart and extend through front flange 42 of vertical support beam 40, a corresponding filler plate 64, a corresponding one of tubes 56 or 58, and through back flange 44 of vertical support beam 40. As a result, the aligned pairs of bolt holes 100A-D form eight discrete channels through which bolts can pass for connecting tubes 56, 58 and filler plates 64 to vertical support beam 40. In addition, if desired, tubes 56, 58 and filler plates 64 can be spot welded to vertical support beam 40.

Figure 5:
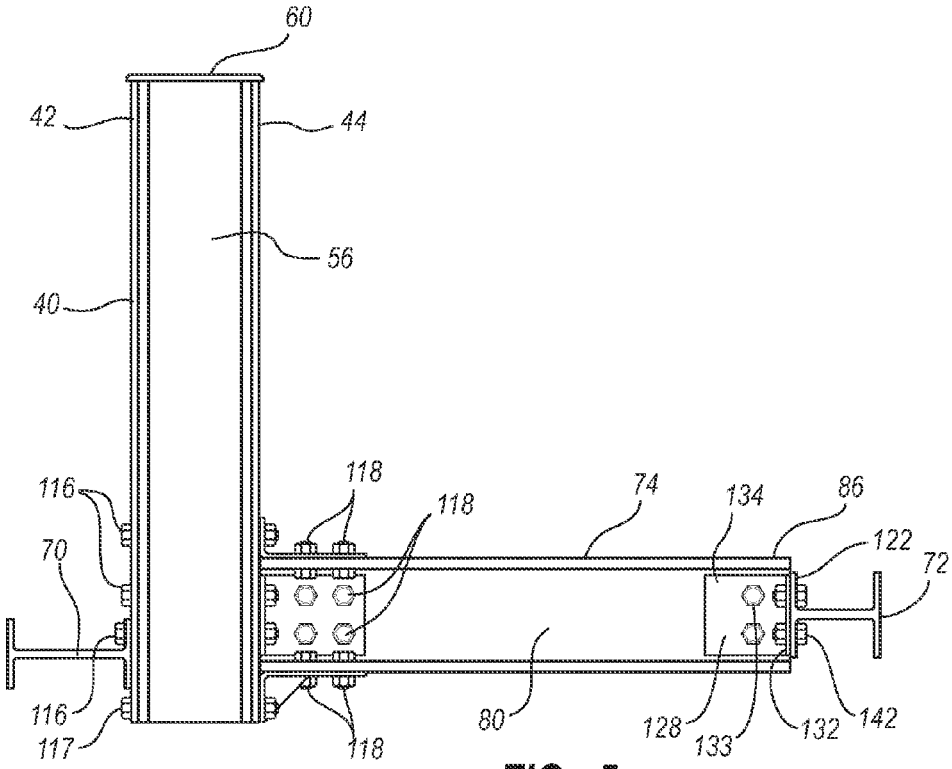
FIG. 5 is an elevated side view of one of the bollards shown in FIG. 4.

Turning to FIG. 5, a top plate 60 is positioned on an upper terminal end face of vertical support beam 40. Top plate 60 typically has a substantially square configuration with side edge measuring 12 inches. Top plate 60 also typically has a thickness of about 1 inch and is welded to flanges 42 and 44 and to tubes 56 and 58 using a ¼ inch fillet weld. Other dimensions can be used for the top plate 60.

Figure 6:
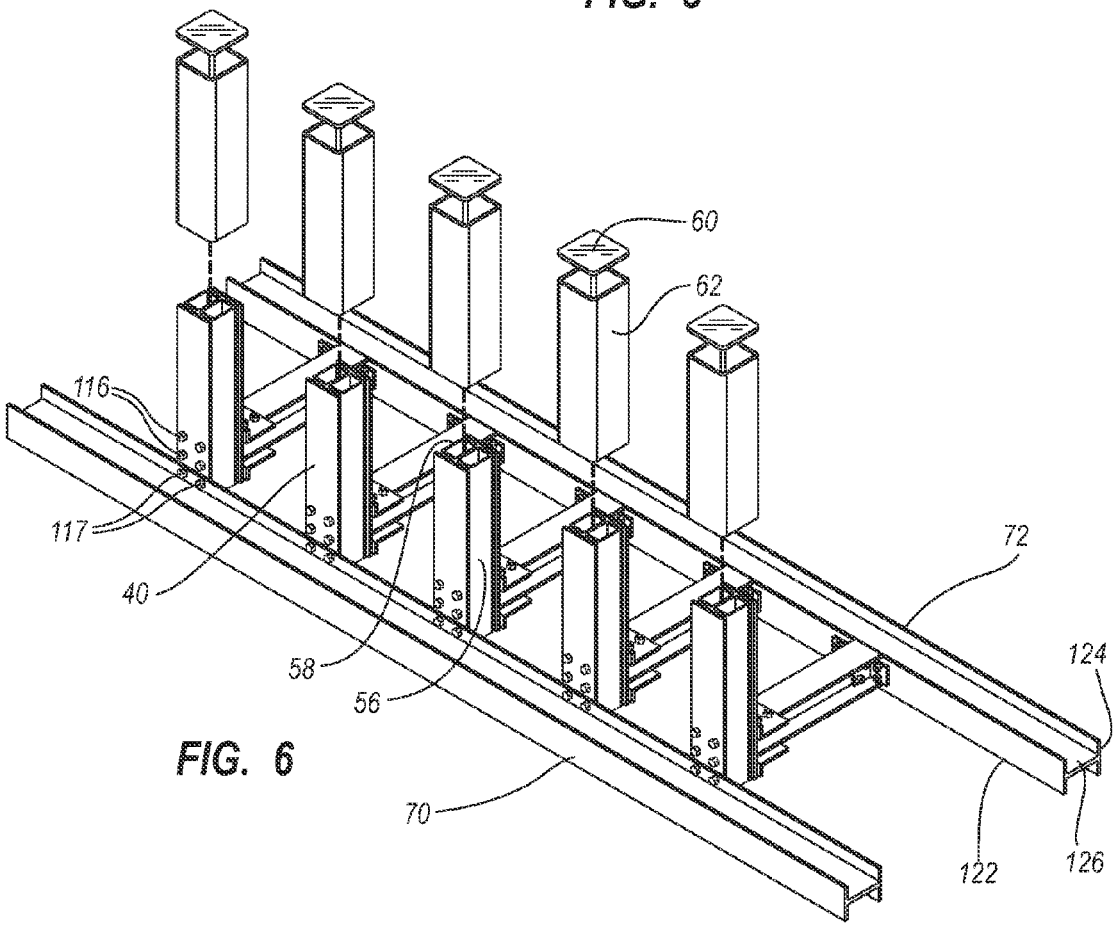
FIG. 6 is a partially exploded view showing the bollards of FIG. 5 and bollard covers.

As depicted in FIG. 6, a tubular cover 62 can be positioned over vertical support beam 40 so as to encircle and cover the exposed portion of vertical support beam 40 and tubes 56 and 58. Each cover 62 typically has a length of approximately 38 inches, a thickness of about 1/16 inch or less, and an interior cross section that is substantially square with each side of a length of about 11.1 inches. Other dimensions can be used for the cover 62. Cover 62 can be positioned over vertical support beam 40 and tubes 56, 58 prior to mounting top plate 60. Once top plate 60 is welded in place, as discussed above, cover 62 is then slid upward and butted against top plate 60. Cover 62 is then secured in place by being welded to top plate 60 at its top and/or by being welded to vertical support beam 40 and/or tubes 56, 58 at its base.

In an alternative method, cover 62 is typically made from a thin sheet metal that is bent into a four-side tube and then opposing ends, i.e., two edges of the sheet metal, are welded together to form the tube. In this embodiment, top plate 60 can initially be welded in place. Cover 62, prior to welding the opposing ends together, can then be wrapped around vertical support beam 40 and then welded in place. Other methods for mounting can also be used.

Cover 62 is primarily ornamental in nature and functions to cover vertical support beam 40 and rectangular tubes 56, 58. As such, in alternative embodiments cover 62 can have a variety of alternative polygonal, circular, shaped or irregular configurations and can have alternative designs and features formed thereon.

Returning to FIG. 3, base 12 (FIG. 1) further comprises a laterally extending front beam 70, laterally extending rear beam 72, and a plurality of horizontal support beams 74 that are positioned therebetween and that are aligned with the corresponding vertical support beams 40. Turning to FIG. 7, front beam 70 typically comprises an I-beam and, more commonly, a wide flange beam (W-beam) having a nominal size of about 8 inches by 5.25 inches, a weight of about 21 pounds per foot, and a length of about 24 feet. Alternative lengths and sizes can also be used. Again, front beam 70 has a substantially I-shaped configuration that includes a front flange 110, a rear flange 112, and a web 114 centrally extending therebetween. As will be discussed below in greater detail, rear flange 112 has a plurality of bolt holes 100C extending therethrough to facilitate bolting front beam 70 to vertical support structure 40.

Returning to FIG. 3, in one embodiment each horizontal support beam 74 comprises an I-beam and, more commonly, a wide flange beam (W-beam) with a nominal size of about 10 inches by 10 inches, a weight of about 68 pounds per foot, and a length of approximately 46 inches. Again, other lengths and sizes can be used. Horizontal support beam 74 has a substantially I-shape configuration that includes a top flange 76, an opposing bottom flange 78, and a web 80 centrally extending therebetween. Horizontal support beam 74 includes a first end 84 that connects to a vertical support beam 40 and an opposing second end 86 that connects to rear beam 72.

Figure 8:
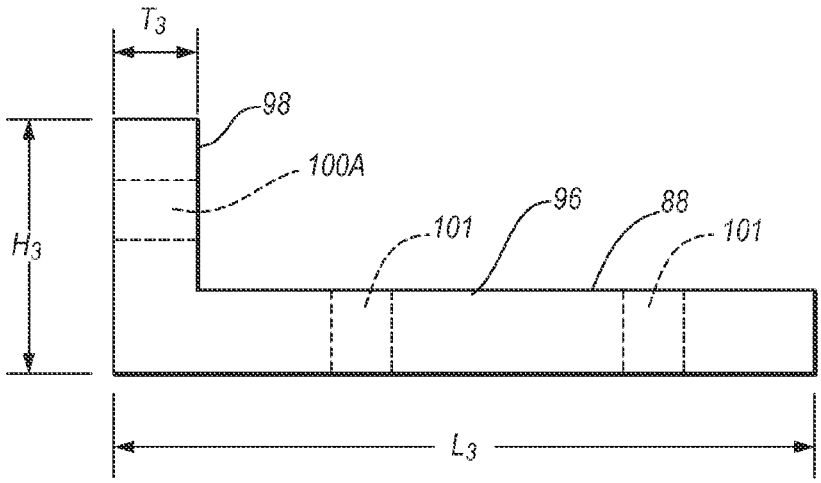
FIG. 8 is an elevated side view of the upper bracket shown in FIG. 7.
Figure 9:
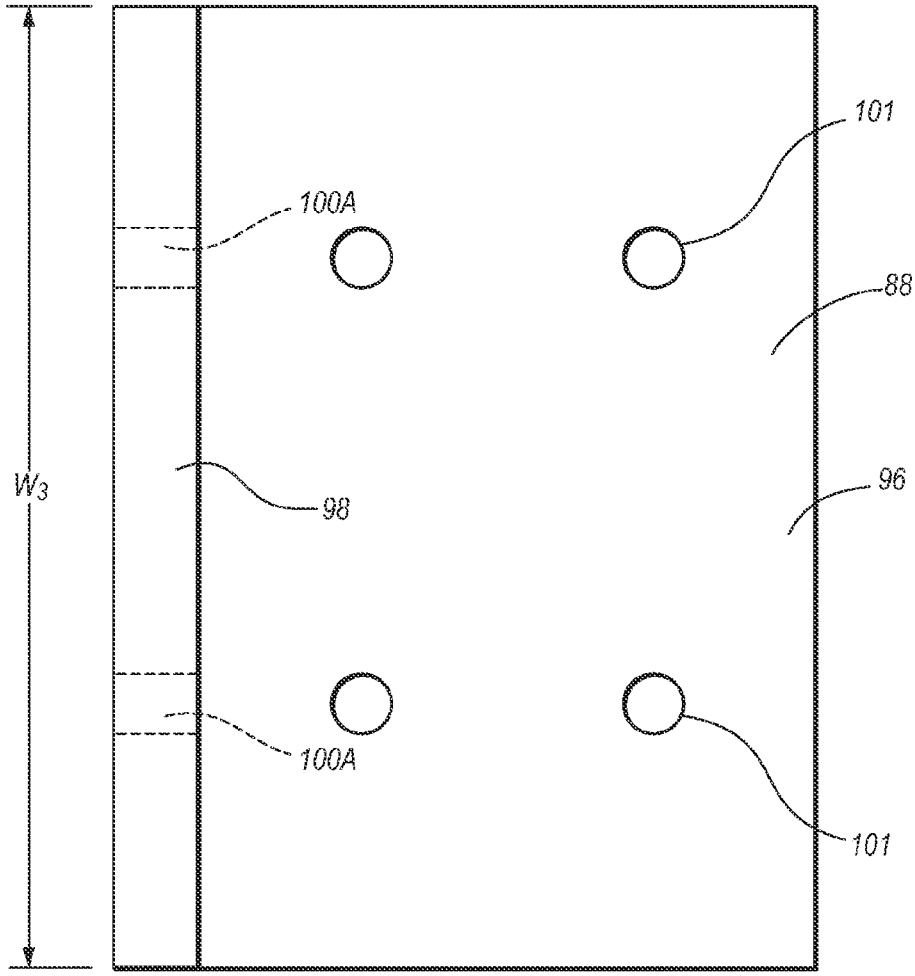
FIG. 9 is a top plan view of the upper bracket shown in FIG. 8.

As depicted in FIG. 4, first end 84 of horizontal support beam 74 is connected to vertical support beam 40 by an upper bracket 88, a lower bracket 90, and a pair of opposing side brackets 92 and 94. As depicted in FIGS. 8 and 9, in one embodiment upper bracket 88 comprises an L-bracket that includes a base 96 and a flange 98 that orthogonally projects from an end thereof Upper bracket 88 has a length $L_3$ of about 8 inches, a height $H_3$ of about 4 inches, a width $W_3$ of about 14 inches and a thickness $T_3$ of about 1 inch. A pair of spaced apart bolt holes 100A extend through flange 98 while four spaced apart bolt holes 101 extend through base 96. All of the bolt holes 100 and 101 in upper bracket 88 have a diameter of about 1 inch.

Figure 10:
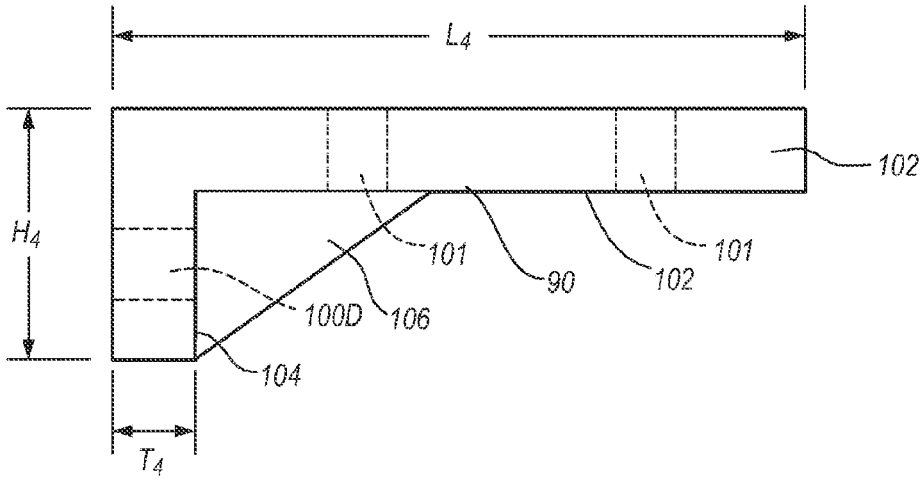
FIG. 10 is an elevated side view of the lower bracket shown in FIG. 7.
Figure 11:
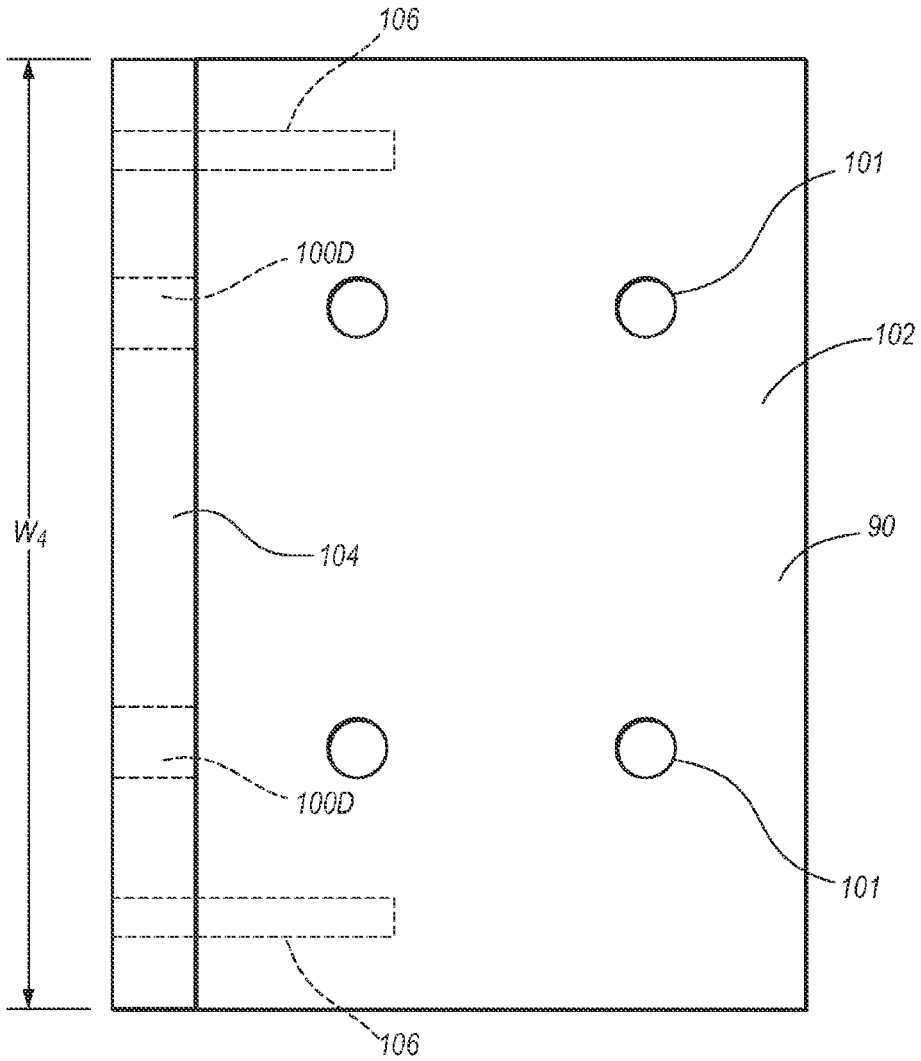
FIG. 11 is a top plan view of the lower bracket shown in FIG. 10.

As depicted in FIGS. 10 and 11, each lower bracket 90 comprises an L-bracket having a base 102 with a flange 104 orthogonally projecting from an end thereof Lower bracket 90 has a length $L_4$ of about 8 inches, a height $H_4$ of about 4 inches, a width $W_4$ of about 14 inches, and a thickness $T_4$ of about 1 inch. A pair of spaced apart, triangular shaped, stiffening wedges 106 extend between base 102 and flange 104. Each stiffening wedge has two equal legs of about 4 inches long and a thickness of about 0.5 inch. Again, a pair of spaced apart bolt holes 100D, each having a diameter of about 1.5 inches, extend through flange 104 while four spaced apart bolt holes 101, each having a diameter of about 1 inch, extend through base 102.

Figure 12:
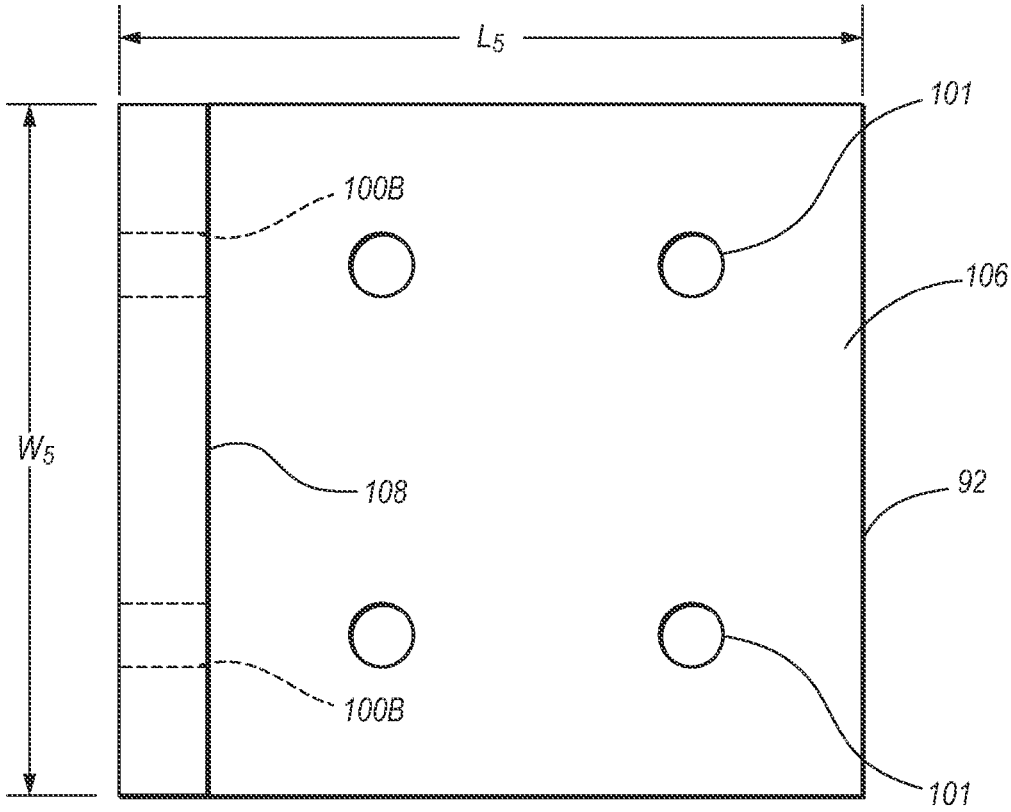
FIG. 12 is an elevated side view of the two side brackets shown in FIG. 7.
Figure 13:
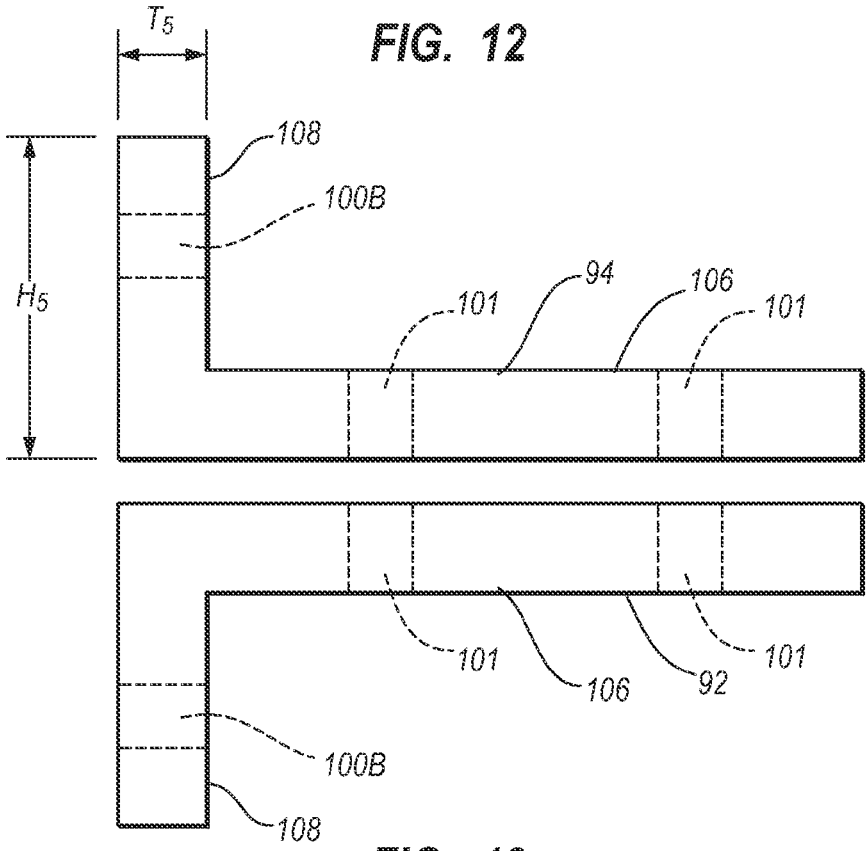
FIG. 13 is a top plan view of the two side brackets shown in FIG. 12.

Turning to FIGS. 12 and 13, each side bracket 92 and 94 comprise an L-bracket having a base 106 and a flange 108 orthogonally projecting from an end thereof Each side bracket 92, 94 has a length $L_5$ of about 8 inches, a height $H_5$ of about 4 inches, a width $W_5$ of about 8 inches, and a thickness $T_5$ of about 1 inch. Again, a pair of spaced apart bolt holes 100A and 100B extend through flange 104 while four spaced apart bolt holes 101 extend through base 106. In the side brackets 92 and 94, all of the bolt holes 100A and B and 101 have a diameter of about 1 inch.

During assembly as depicted in FIG. 7, horizontal support beam 74 is coupled with vertical support beam 40 by butting first end 84 of horizontal support beam 74 against back flange 44 of vertical support beam 40 at second end 50. Upper bracket 88 is mounted at the intersection of top flange 76 of horizontal support beam 74 and back flange 44 of vertical support beam 40 so that bolt holes 100A of upper bracket 88 are align with bolt holes 100A extending through vertical support beam 40. Likewise, lower bracket 90 is positioned at the intersection of back flange 44 of vertical support beam 40 and bottom flange 78 of horizontal support beam 74. Again, bolt holes 100D on lower bracket 90 are aligned with bolt holes 100D extending through vertical support beam 40. Side brackets 92 and 94 are positioned at the intersection of back flange 44 of vertical support beam 40 and opposing sides of web 80 of horizontal support beam 74. In this embodiment, each of bolt holes 100B and C of side brackets 92 and 94 are aligned with corresponding bolt holes 100B and 100C extending through vertical support beam 40. In addition, front beam 70 is positioned so that rear flange 112 butts against front flange 42 of vertical support beam 40 with bolt holes 100C of front beam 70 being aligned with bolt holes 100C extending through vertical support beam 40. Here it is noted that front beam 70 is vertically spaced apart from a bottom terminal end face 105 of vertical support beam 40 by a distance X that is about 2.75 inches.

Turning to FIG. 5, in the above configuration bolts 116, each having a diameter of about 1 inch, are then passed through all aligned bolt holes 100A, 100B and 100C and fastened with threaded nuts so as to secure the aligned structures together. Bolts 117, each having a diameter of about 1.5 inches, are also passed through all aligned bolt holes 100D and fastened with threaded nuts so as to secure the aligned structures together. Also in this configuration, each bolt hole 101 in brackets 88, 90, 92, and 94 is aligned with a corresponding bolt hole 101 extending through horizontal support beam 74 (FIG. 7). Bolts 118, each having a diameter of about 1 inch, are passed through all align bolt holes 101 and fastened with threaded nuts. Accordingly, bolts 116, 117 and 118 function to secure together front beam 70, vertical support beam 40, rectangular tubes 56, 58, filler plates 64, brackets 88, 90, 92, and 94 and horizontal support beam 74. To further secure together the above mechanical engagement, a ¼ inch fillet weld can be formed along the intersecting surfaces between lower bracket 90 and horizontal support beam 74 and between lower bracket 90 and vertical support beam 40. If desired, fillet welds can also be formed between the other mechanically connected surfaces.

Returning to FIG. 6, rear beam 72 comprises an I-beam and, more commonly, a wide flange beam (W-beam) with a nominal size of 6 inches by 4 inches with a weight of 12 pounds per foot and a length equal to that of front beam 70. Rear beam 72 has a substantially I-shaped configuration which includes a front flange 122, a rear flange 124, and a web 126 centrally extending therebetween. As depicted in FIG. 4, brackets 128 and 130 are used to secure rear beam 72 to horizontal support beam 74.

Figure 14:
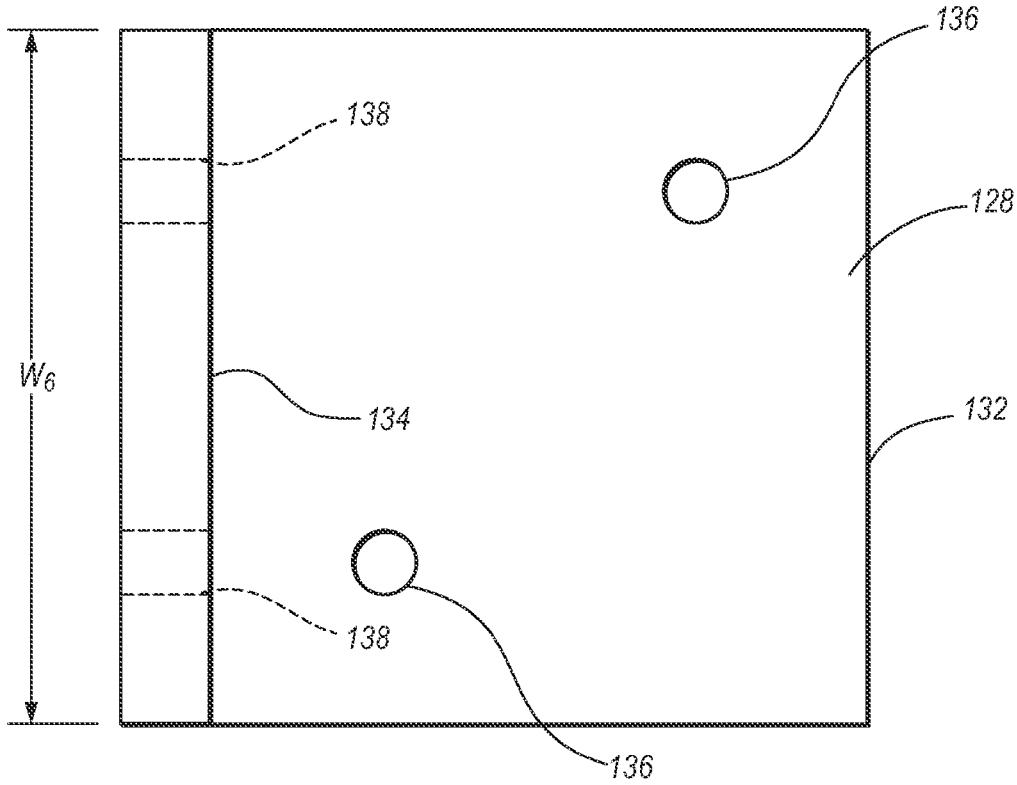
FIG. 14 is an elevated side of the rear bracket shown in FIG. 5.
Figure 15:
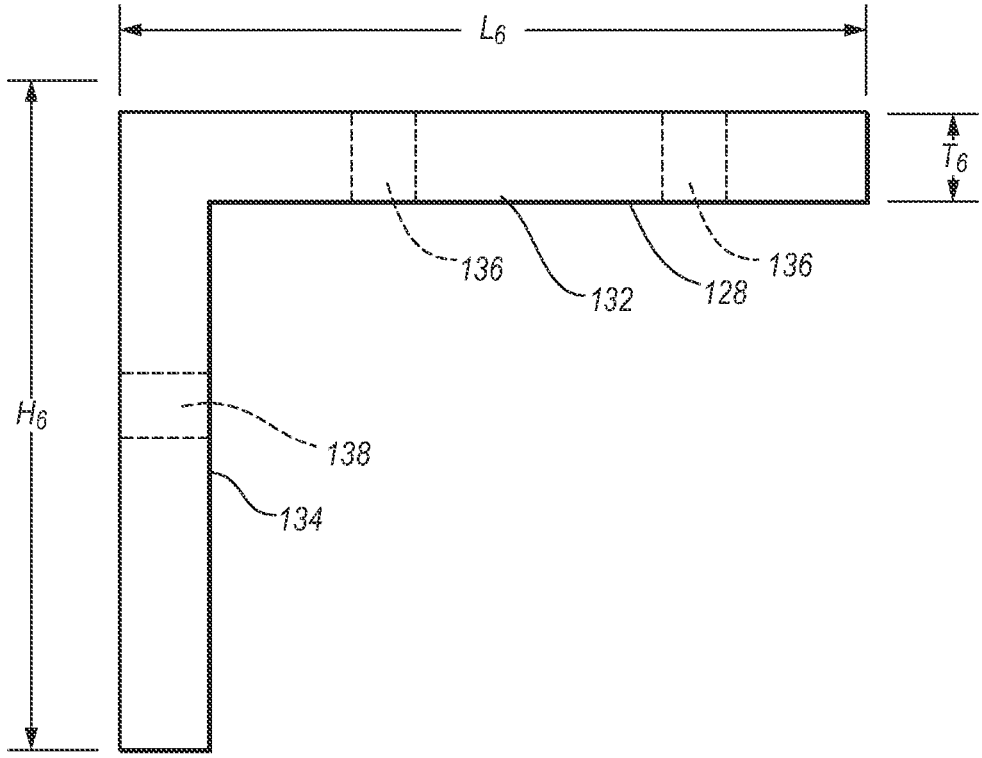
FIG. 15 is a top plan view of the rear brackets shown in FIG. 14.

As depicted in FIGS. 14 and 15, each bracket 128 and 130 comprises a V-bracket that includes a first arm 132 and a second arm 134 orthogonally projecting from an end thereof Each bracket 128 and 130 has a length $L_6$ of about 5 inches, a height $H_6$ of about 5 inches, a width $W_6$ of about 4 inches, and a thickness $T_6$ of about 0.5 inch. A pair of laterally spaced apart bolt holes 136 extends through first arm 132 while a pair of vertically spaced apart bolt holes 138 extends through second arm 134. Bolt holes 136 and 138 each have a diameter of about 0.5 inch.

As depicted in FIGS. 4 and 5, second arm 134 of brackets 128 and 130 are centrally mounted on opposing sides of web 80 of horizontal support beam 74 at second end 74. Bolt holes 138 in brackets 128 and 130 are aligned with bolt holes extending through web 80 of horizontal support beam 74 so that bolts 133 can pass through bracket 128, web 80, and bracket 130 and be secured thereto by threaded engagement with nuts. In turn, front flange 122 of rear beam 72 is butted against the terminal end face at second end 86 of horizontal support beam 74. Bolts 142 are then passed through bolt holes 136 in first arm 132 of brackets 128 and 130 and through aligned bolt holes in front flange 122 of rear beam 72 so as to secure together horizontal support beam 74 and rear beam 72.

Figure 16:
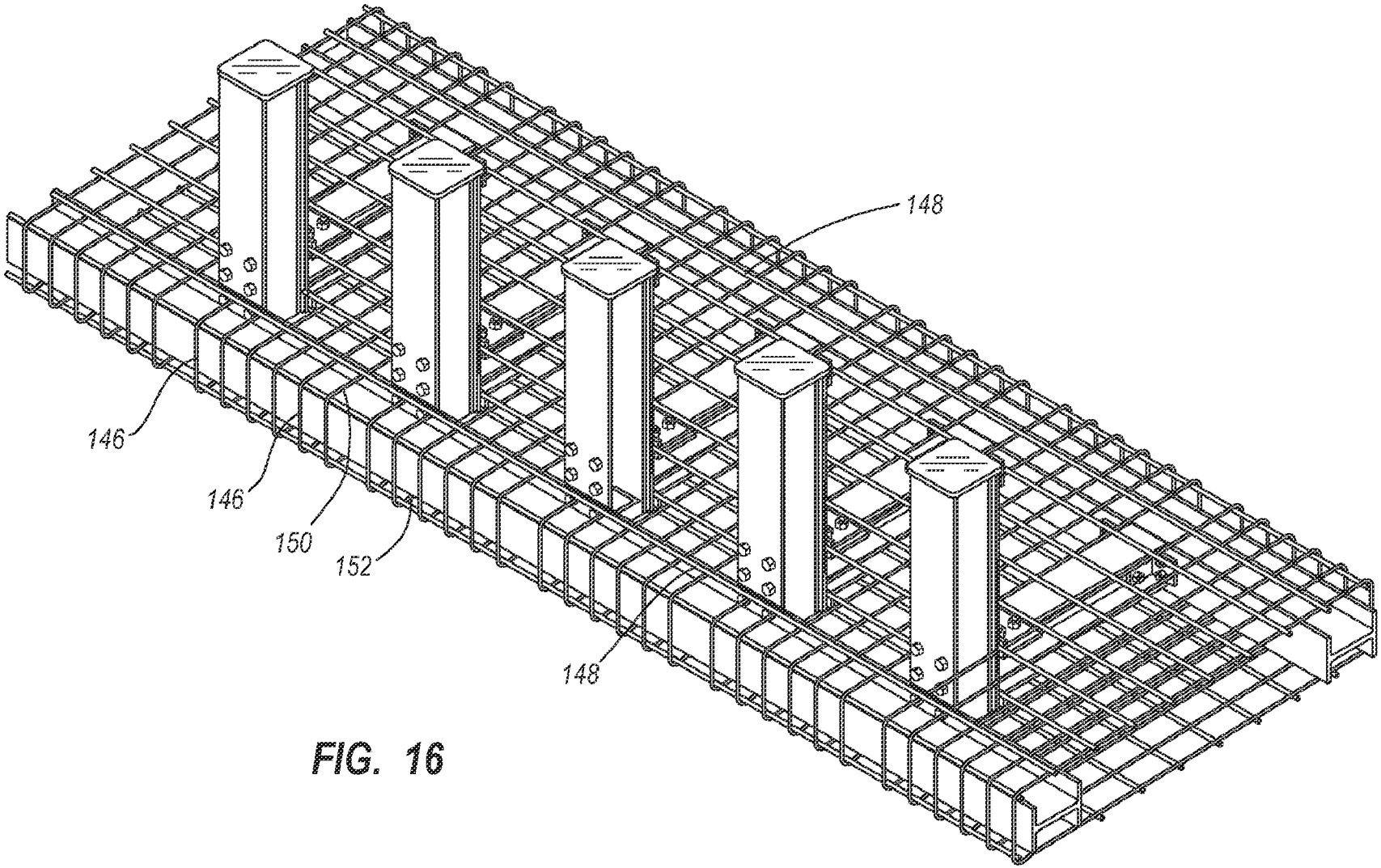
FIG. 16 is a perspective view of the bollard system shown in FIG. 6 having rebar mounted thereon.

Next, as depicted in FIG. 16, rebar is positioned around front beam 70, rear beam 72, and horizontal support beam 74. Specifically, a plurality of laterally spaced apart sections of looped rebar 146 are positioned in a loop that extends from front beam 70 to rear beam 72 above horizontal support beam 74 and from rear beam 72 to front beam 70 below horizontal support beam 74. The portions of looped rebar 146 above and below horizontal support beam 74 are disposed in substantially parallel planes that form an upper surface 150 and an opposing lower surface 152. A plurality of sections of lateral rebar 148 extend along the length of front beam 70 and rear beam 72 at spaced apart distances along upper surface 150 and lower surface 152 of looped rebar 146. Loop rebar 146 typically comprises #5 rebar having a diameter of approximately ⅝ inch while the lateral rebar is typically #6 rebar having a diameter of ⅝ inch.

Once the rebar is positioned, a perimeter form can be built and concrete poured into the form so as to form a concrete slab that covers and encases the rebar, front beam 70, rear beam 72, and horizontal support beam 74. The concrete is poured so that the resulting concrete slab, which defines the outer perimeter of base 12, has the dimensions as previously discussed with regard to FIGS. 1 and 2.

The foregoing example provides specific measurements for each element of one embodiment of fixed bollard system 10. In alternative embodiments, it is appreciated that each of the different discussed measurements can be varied by ±5%, ±10%, ±15%, or ±20%. This is especially true where fixed bollard system 10 need not sustain a K-12 impact test. Likewise, still other dimensions can also be used. Furthermore, it is appreciated that many of the members discussed herein are connected together by bolting so as to minimize the amount of welding required. Different sizes for the bolts can be used. The bolts can also be replaced with expansion bolts, rivets, and other conventional types of fasteners. Likewise, the bolts can be eliminated by securing the elements together using welding. In one typical embodiment, all structural parts described herein are made from structural steel (ST-50), all rebar are made from structural steel (ST-60), all bolts are grade-8, and the concrete has a minimum strength of 3,000 psi. Other materials can be used.

Different embodiments of the present have a number of unique advantages. For example, in one embodiment fixed bollard system 10 can have a low profile base 12 having a height that is less than 24 inches and more commonly less than 20 inches while still enabling the fixed bollard system 10 to sustain a K-12 impact test. This enables the system to be more easily retrofitted around existing structures within a town or city where it can be difficult to dig deep holes due to existing utility lines. Fixed bollard system 10 can also be made from standard off the shelf parts so that no complicated fabrication is required. For example, all I-beams used in the present system can be replaced by standard square or rectangular tubes and yet still be connected together using the above discussed bolted flanges or other fastening techniques.

Furthermore, because a majority of the fixed bollard system 10 can simply be bolted together, the inventive system provides relatively easy assembly and installation. Regarding installation, it is appreciated that the present system can be prefabricated in a shop to the extent as depicted in FIG. 6. That is, the complete system can be fabricated in a shop except for the addition of the rebar and concrete. The partial assembly can then be shipped to the desired location where it is positioned within a preformed hole or within an area bounded by a form. Once the rebar is added, the concrete can be poured and the fixed bollard system 10 is complete. Where an extended length of bollards are required, discrete sections of bollards can be formed end to end.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A fixed bollard system, comprising:

a plurality of spaced apart elongated bollards each longitudinally disposed along a corresponding X-axis, each bollard being comprised of:

an I-beam having a front face and an opposing back face with opposing side channels formed therebetween that each extend between a top end and an opposing bottom end; and a pair of elongated support structures, each support structure being secured within a corresponding one of the side channels of the I-beam and extending along the length thereof;

a plurality of horizontal support beams each longitudinally disposed along a corresponding Y-axis, each horizontal support beam being comprised of an I-beam and having a first end and an opposing second end, the first end terminating at a first end face, the first end of each horizontal support beam being connected to the back face of a corresponding bollard at the bottom end so that the first end face of each horizontal support beam is disposed directly against the back face of the corresponding bollard;

an elongated lateral front beam connected directly to the front face of each of the plurality of bollards at the bottom ends thereof, the front beam being disposed along a first Z-axis that is disposed substantially 90 degrees relative to each X-axis and Y-axes; and an elongated lateral rear beam connected to the second end of each of the plurality of horizontal support beams, the rear beam being disposed along a second Z-axis that is substantially parallel to the first Z-axis.

2. The fixed bollard system of claim 1, wherein the front beam and the rear beam are each comprised of an I-beam.

3. The fixed bollard system of claim 1, wherein each horizontal support beam is bolted to a corresponding bollard using two first L-brackets disposed in a first direction and two second L-brackets disposed in a second direction, the second direction being perpendicular to the first direction.

4. The fixed bollard system of claim 1, wherein the pair of elongated support structures comprise a first tube and a second tube each extending along the length of the I-beam of the bollard.

5. The fixed bollard system of claim 4, further comprising a metal cap welded directly to the top end of the I-beam of the bollard.

6. The fixed bollard system of claim 1, further comprising a continuous concrete slab enclosing each of the plurality of horizontal support beams and enclosing the bottom end of each of the bollards, the concrete slab having a top surface from which the bollards outwardly project and an opposing bottom surface.

7. The fixed bollard system of claim 6, wherein each bollard outwardly projects from the top surface of the concrete slab by a distance in a range between about 32 inches to about 42 inches.

8. The fixed bollard system of claim 6, wherein the concrete slab has a thickness extending between the top surface and the opposing bottom surface that is less than twenty inches.

9. The fixed bollard system of claim 6, wherein the plurality of bollards are able to repel a 15,000 pound truck traveling at 50 mph.

10. The fixed bollard system of claim 1, wherein the plurality of spaced apart elongated bollards comprises at least three bollards.

11. A fixed bollard system, comprising:

a plurality of spaced apart elongated bollards each longitudinally disposed along a corresponding X-axis, each bollard being comprised of:

a vertical support beam having a front face and an opposing back face with opposing side channels formed therebetween that each extend between a top end and an opposing bottom end; and a pair of elongated support structures, each support structure being secured within a corresponding one of the side channels of the vertical support beam and extending along the length thereof;

a plurality of horizontal support beams each longitudinally disposed along a corresponding Y-axis, each horizontal support beam having a first end and an opposing second end, the first end terminating at a first end face, the first end of each horizontal support beam being connected directly to the back face of a corresponding vertical support beam at the bottom end thereof by a plurality of bolts and a plurality L-brackets so that the first end face of each horizontal support beam is disposed directly adjacent to the back face of the corresponding vertical support beam;

an elongated lateral front beam connected directly to the front face of each of the plurality of bollards at the bottom ends thereof, the front beam being disposed along a first Z-axis that is disposed substantially 90 degrees relative to each X-axis and Y-axes; and an elongated lateral rear beam connected to the second end of each of the plurality of horizontal support beams, the rear beam being disposed along a second Z-axis that is substantially parallel to the first Z-axis.

12. The fixed bollard system of claim 11, wherein the vertical support beam and the horizontal support beam are each comprised of an I-beam.

13. The fixed bollard system of claim 11, wherein the first end face of each horizontal support beam is butted directly against the back face of the corresponding vertical support beam.

14. The fixed bollard system of claim 11, further comprising a metal cap welded directly to the vertical support beam of the bollard at the first end thereof.

15. The fixed bollard system of claim 11, further comprising a continuous concrete slab enclosing each of the plurality of horizontal support beams and enclosing the bottom end of each of the bollards, the concrete slab having a top surface from which the bollards outwardly project and an opposing bottom surface.

16. The fixed bollard system of claim 15, wherein each bollard outwardly projects from the top surface of the concrete slab by a distance in a range between about 32 inches to about 42 inches.

17. The fixed bollard system of claim 15, wherein the concrete slab has a thickness extending between the top surface and the opposing bottom surface that is less than twenty inches.

18. The fixed bollard system of claim 15, wherein the plurality of bollards are able to repel a 15,000 pound truck traveling at 50 mph.

19. The fixed bollard system of claim 11, wherein the pair of elongated support structures comprise a first tube and a second tube.

20. A method of manufacturing a fixed bollard system, the method comprising:

assembling a first fixed bollard frame assembly at a first location, the fixed bollard frame assembly comprising:

a plurality of spaced apart, elongated bollards each longitudinally disposed along a corresponding X-axis, each bollard being comprised of:

an I-beam having a front face and an opposing back face with opposing side channels formed therebetween that each extend between a top end and an opposing bottom end; and a pair of elongated support structures, each support structure being secured within a corresponding one of the side channels of the I-beam and extending along the length thereof;

a plurality of horizontal support beams each longitudinally disposed along a corresponding Y-axis, each horizontal support beam being comprised of an I-beam and having a first end and an opposing second end, the first end terminating at a first end face, the first end of each horizontal support beam being connected directly to the back face of a corresponding bollard at the bottom end so that the first end face of each horizontal support beam is disposed directly against the back face of the corresponding vertical support beam;

an elongated lateral front beam connected directly to the front face of each of the plurality of bollards at the bottom ends thereof; and an elongated lateral rear beam connected to the second end of each of the plurality of horizontal support beams;

transporting the assembled first fixed bollard frame assembly to a second location;

fixing rebar about the plurality of horizontal support beams when the assembled first fixed bollard frame assembly is at second location; and pouring a concrete slab at the second location so that the concrete slab encloses each of the plurality of horizontal support beams, the front and rear lateral beams and the bottom each of each of the plurality of bollards.

21. The method as recited in claim 20, further comprising pouring the concrete slab so that it has a thickness extending between a top surface and an opposing bottom surface that is less than twenty inches.

* * * * *